US005405543A

United States Patent [19]

Otake et al.

[11] Patent Number: 5,405,543

[45] Date of Patent: Apr. 11, 1995

[54] GREASE FOR COPPER CONTACT

[75] Inventors: Sugako Otake; Takeshi Kojima, both of Aichi; Eigo Mukasa, Fujisawa; Kikuo Hosaki, Tokyo, all of Japan

[73] Assignee: Kabushiki Kaisha Tokai Rika Denki Seisakusho, Aichi, Japan

[21] Appl. No.: 798,143

[22] Filed: Nov. 26, 1991

Related U.S. Application Data

[63] Continuation-in-part of Ser. No. 547,131, Jul. 3, 1990, abandoned.

[30] Foreign Application Priority Data

Jul. 4, 1989 [JP] Japan ..... 1-172580

[51] Int. Cl.[6] ..... C10M 141/06

[52] U.S. Cl. ..... 252/21; 252/46.3; 252/50; 252/52 R; 252/56 S

[58] Field of Search ..... 252/32.7 E, 18, 21, 252/34.7, 46.3, 57, 50, 56 S

[56] References Cited

U.S. PATENT DOCUMENTS

| | | | |
|---|---|---|---|
| 3,371,120 | 2/1968 | Nowotny | 252/46.3 |
| 3,449,248 | 6/1969 | Butcosk | 252/21 |
| 3,814,689 | 6/1974 | Christian | 252/21 |
| 4,298,481 | 11/1981 | Clarke | 252/21 |
| 4,507,215 | 3/1985 | Schroeck | 252/32.7 E |
| 4,522,632 | 6/1985 | Horodysky et al. | 252/32.7 E |

*Primary Examiner*—Margaret Medley

*Attorney, Agent, or Firm*—Birch, Stewart, Kolasch & Birch

[57] ABSTRACT

The present invention provides a grease for copper electrical contacts having excellent properties which comprises polyol complex ester base oil and a specific amount of particular additives, i.e. quaternary ammonium salt-containing clay mineral, secondary aromatic amine antioxidant and a copper deactivator selected from the group consisting of benzotriazoles, thiodiazoles, and N,N'-disalicylidene-1,2-diaminopropane. The grease according to the present invention can be applied effectively to a copper slide contact under both low temperature (ca.—40° C.) and high temperature (ca. 160° C.) conditions.

2 Claims, 8 Drawing Sheets

GREASE FOR COPPER CONTACT

This application is a continuation-in-part of application Ser. No. 07/547,131 filed on Jul. 3, 1990, now abandoned.

TECHNICAL FIELD

This invention relates to a grease for copper electrical contacts which can be used at from low temperature to high temperature (ca. −40° -ca. +160° C.).

BACKGROUND ART

Although various kinds of sliding switches are normally used at about from −30° C. to +80° C., the temperature of a copper contact increases to about 160° C. quite often, said copper contact being widely used from a viewpoint of cost in a switch attached directly to an engine chamber of automobiles, aircraft and the like, a change-over switch of heater or heating element, and control switch or connector used in an unattended factory. For this reason, usual greases are not adequate for use under these circumstances.

For example, a grease containing lithium salt of higher fatty acid as a thickner increases the electrical contact voltage drop between the copper contacts because the lithium salt (lithium stearate) is oxidized to a varnish solid when the temperature of the contacts increases to 130° C.-160° C. Although commercially available greases comprising polyol hindered esters as a base oil which are developed for a jet engine operated at a condition of low and high temperatures such as "Nye Rheolube 789 DM" (William F. Nye Inc., United States) can be generally used at from −40° C. to +150° C. and produce only a small amount of carbonized residue when they are heated under high temperature conditions such as electric arc, they oxidize the copper contacts remarkably and increase electrical contact resistance under the condition of 140° C./40 H.

In view of the aforementioned situation, the present invention is carried out in order to provide a durable grease for copper electrical contact which is fit for use under the condition of low and high temperatures ca. −40° C.-ca. +160° C.) and much moisture and which not only does not corrode the copper contact but also does not bring about increased electrical contact resistance caused by its deterioration with the passage of time, said grease giving good durability to the electrical contact under arc generating conditions as a result of the small amount of carbonized residue.

SUMMARY OF THE INVENTION

The object of the present invention is to provide a grease for a copper electrical contact which comprises 100 parts by weight of polyol complex ester base oil, 10–30 parts by weight of quaternary ammonium salt-containing clay mineral, 0.05–3 parts by weight of secondary aromatic amine antioxidant and 0.05–3 parts by weight of a copper deactivator selected from the class consisting of benzotriazoles, thiadiazoles and N,N'-disalicylidene-1,2-diaminopropane.

DETAILED DESCRIPTION OF THE INVENTION

Figure 1:
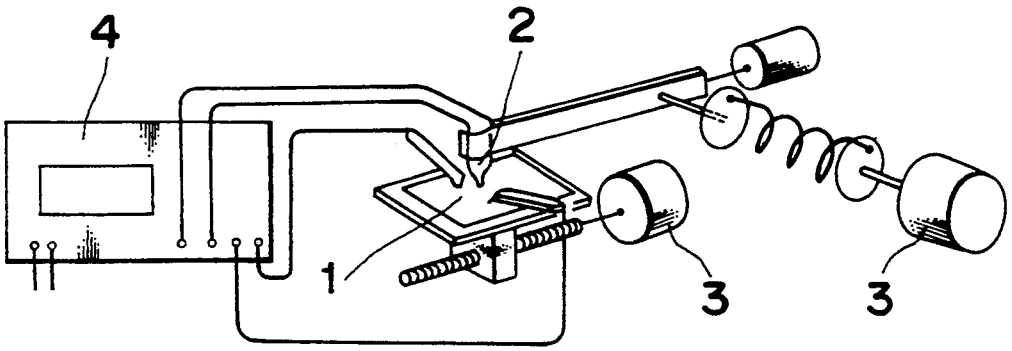
FIG. 1 is a schematic mechanism of electrical contact simulator.

According to the present invention, a grease for copper electrical contact is provided, said grease comprising 100 parts by weight of polyol complex ester base oil, 10–30 parts by weight of quaternary ammonium salt-containing clay mineral, 0.05–3 parts by weight of secondary aromatic amine antioxidant and 0.05–3 parts by weight of a copper deactivator selected from the class consisting of benzotriazoles, thiadiazoles and N,N'-disalicylidene-1,2-diaminopropane.

The polyol complex ester employed in the present invention has a pour point of −40° C. and less and produces only a small amount of carbonized residue under high temperature condition such as arc generating condition. The polyol complex ester can be prepared by esterification of polyvalent alcohols having two or more hydroxyl groups in the molecule such as neopentyl glycol, trimethylol propane and pentaerythritol, which are neopentyl type alcohols whose B-carbon atoms have no hydrogen atom, with linear or branched chain $C_3$–$C_{18}$ carboxylic acids or mixture thereof. Trimethyl propane trialkylate, polyol complex ester of trimethylol propane and $C_3$–$C_{18}$ fatty acid mixture such as "Unistar C3371A" (Nihon Yushi Inc.) and the like are exemplified, the polyol complex ester being preferred because said ester has lower pour point than that of the conventional polyol ester.

In order to improve thermostability of the grease, 50 percents by weight and less of diphenyl ether having alkyl substituents represented by the following formula (I) may optionally be added to the polyol ester base oil if necessary:

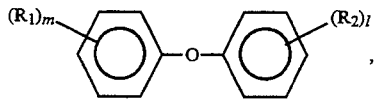

(I)

wherein $R_1$ and $R_2$ are same or different $C_{10}$–$C_{22}$ alkyl groups which may have a branched chain and m and l are integer of from 0 to 5, provided that $6 \geqq m+l \geqq 1$.

As particularly preferred quaternary ammonium salt-containing clay minerals used in the present invention, dimethyloctadecyl ammonium montmorillonite, dimehtylpentyl octadecyl ammonium hectolite, the mixture thereof, aromatic ammonium compound-containing montmorillonite such as monoalkyl benzyltrialkyl ammonium-containing montmorillonite and the like are exemplified.

The blending amount of the clay minerals is 10–30 parts by weight, preferably 15–25 parts by weight, in relation to 100 parts by weight of the base oil. If the amount of the clay mineral is below 10 parts by weight, adhesiveness and oil separativeness of the grease are lowered. When the blending amount of the clay mineral is above 30 parts by weight, coating properties and lubricity of the grease become worse.

As the secondary aromatic amines employed in the present invention, diphenylamine, phenylnaphtylamine, diphenyl-p-phenylenediamine, dioctyldiphenylamine and the mixture thereof are exemplified.

The blending amount of the secondary aromatic amines is 0.05–3 parts by weight, preferably 0.1–1.0 part by weight, in relation to 100 parts by weight of the base oil. If the amount of the amine is below 0.05 part by weight, satisfactory effect of the amine as an antioxidant is not obtained. When the amount of the amine is above 30 parts by weight, antioxidant effect is not increase in particular.

As the copper deactivator used in the present invention, benzotriazol, thiadiazoles, N,N'-disalicylidene-1,2-diaminopropane and the like are exemplified, In particular, benzotriazole is preferred. The use of the copper deactivator together with the aforesaid secondary aromatic amine antioxidant brings about a synergetic effect concerning contact resistance under high-temperature conditions, such as arc generating conditions. The synergetic effect is illustrated by examples and comparisons shown below (cf. FIGS. 18–21).

The blending amount of the copper deactivator is 0.05–3 parts by weight, preferably 0.1–0.5 part by weight, in relation to 100 parts by weight of the base oil. If the amount of the copper deactivator is below 0.05 part by weight, satisfactory effect threreof is not obtained. When the blending amount of the copper deactivator is above 3 parts by weight, not only anticorrosive effect is not increased but also said agent exerts harmful influence upon other properties of the grease.

Furthermore, various conventional additives such as polymeric adhesives, lowering agent of pour point and the like may be added to the grease for a copper contact according to the present invention if necessary.

The present invention is illustrated by the following examples.

EXAMPLES

EXAMPLE 1

Grease 1 was prepared according to the following procedure in conformity with the blending prescriptions described in Table 1.

Polyol complex ester "Unistar C 3371 A" (Nihon Yushi Inc., Japan) and quaternary ammonium salt-containing clay mineral "PARAGEL" (National Red. Corp.) were admixed sufficiently, methyl alcohol was added and stirring was continued until homogeneous mixture was formed. The solvent was evaporated under heating and benzotriazole and diphenylamine were added to the mixture at the point of time when the temperature of the mixture was 100° C. The mixture was cooled down to room temperature. The grease 1 was prepared by subjecting the mixture to finishing treatment by means of three-roll mill.

Properties of the grease 1 are shown in Table 1.

The grease 1 was subjected to various following property tests as a grease for copper contact. The results of the tests are shown in Table 2.

(1) Anticorrosiveness of copper contact under high temperature

Test (i): The grease was coated on the buffed pure copper plate (coating weight: 10 mg/cm$^2$) and said coated copper plate was kept in the thermostat (160° C.) for 42 hours. The copper plate was set as a sample contact (1) on the electrical contact simulator as shown in FIG. 1 after observing appearances of the grease and the copper contact. Contact resistances were measured by sliding the gold contact (2) on the sample contact (1) under electric current of 1 mA and contact pressures of from 0 to 100 g. In FIG. 1, (3) and (4) denote synchronous motor and resistor respectively.

Test (ii): The grease was coated on the buffed pure copper plate (coating weight: 10 mg/cm$^2$) and said coated copper plate was kept in the thermostat (160° C.) for 100 hours. The copper plate was set as a sample contact (1) on the electrical contact simulator as shown in FIG. 1 after observing appearances of the grease and the copper contact. Contact resistances were measured by sliding the gold contact (2) on the sample contact (1) under electric current of 1 mA and static contact pressures of 40 g.

(2) Durability performance test of a switch

Figure 2:
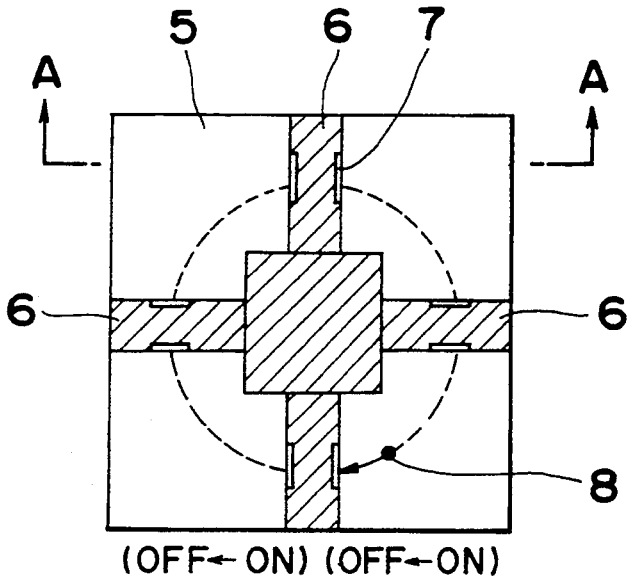
FIG. 2 is a schematic plan of the test sample for a sliding switch.
Figure 3:
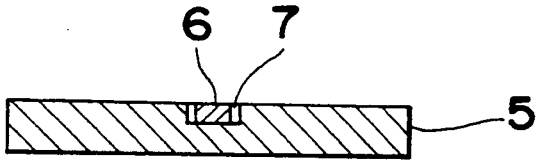
FIG. 3 is a schematic cross section of the test sample along A—A line shown in FIG. 2.

Test sample: The sliding switch as a test sample, which is similar to the actually used sliding switch, shown in FIGS. 2 and 3 was constructed. FIG. 2 is a schematic plan of the test sample and FIG. 3 is a schematic cross section of the test sample along A—A line shown in FIG. 2. A stator consists of the fixed copper contacts (6) and the insulator (5) made of nylon 66 with which inorganic filler is blended. The fixed copper contacts (6) are buried in the insulator (5) and air gap (7) are provided in the switching parts of the contacts. The grease sample was coated on the surfaces of the insulator and the fixed contacts on which the movable contact (8) slide rotatively.

Figure 4:
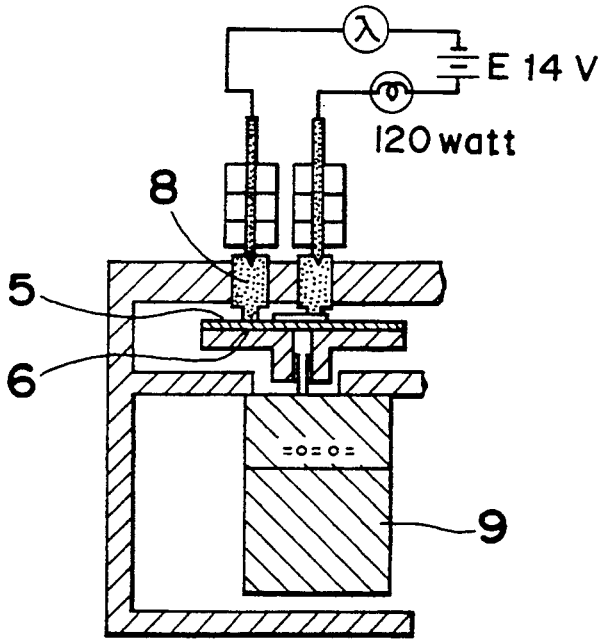
FIG. 4 is a schematic cross section of the apparatus for testing durability of a grease through the principal part thereof.

Test apparatus: The test sample as prepared above was fixed to the rotator which is fixed to the rotary motor (9) as shown in FIG. 4. Constant load (DC 14 V, 120 W lamp) was switched by rotating the motor at 15 times/minute. The switching test was conducted 100,000 times. Insulation resistance of the insulator (5) was measured at a point which is 3 mm away from the edges of the fixed contacts (6) which are bounded by the air gap (7).

(3) Corrosion resistance of the copper contact Grease sample was coated on the buffed pure copper plate (0.7 cm×7 cm×3 mm) (coating weight: 10 mg/cm$^2$) and said coated copper plate was kept in the thermostat (60° C., 95% RH) for 120 hours. Discoloration of the surface of the copper plate was observed. Contact resistances were measured by means of aforesaid electrical contact simulator under electric current of 1 mA and static contact pressure of 50 g.

EXAMPLE 2

Grease 2 was prepared according to the procedure described in Example 1 in conformity with the blending prescriptions described in Table 1. Properties of the grease 1 are shown in Table 1.

The grease 2 was subjected to the various property tests as a grease for copper contact as described in Example 1. The results obtained are shown in Table 2.

COMPARATIVE EXAMPLES 1 AND 2

Grease 1' was prepared according to the following procedure in conformity with the blending prescription described in Table 1.

Polyol complex ester and lithium stearate were admixed sufficiently under stirring. The stirring was continued until the temperature of the mixture increased to 185° C. and then the mixture was cooled down under stirring. Benzotriazole and diphenylamine "MORESCO RP-42S" (Matsumura Oil Research Corp.) were added to the mixture at the point of time when the temperature of the mixture was 100° C.

The grease 1' was prepared by subjecting the mixture to finishing treatment by means of three-roll.

Grease 2' was prepared according to the above procedure in conformity with the blending prescription described in Table 1.

Properties of the grease 1' and 2' are shown in Table 1. These greases were subjected to the various property tests as a grease for copper contact as described in Example 1. The results obtained are shown in Table 2.

COMPARATIVE EXAMPLE 3

Commercially available grease "Nye Rheolube 789DM" (William F. Nye Inc.) whose base oil is considered as a polyol ester was subjected to the various property tests for copper contact as described in Example 1. The results obtained are shown in Table 2 wherein the grease 3' denotes this commercially available grease.

COMPARATIVE EXAMPLES 4', 5' AND 6'

Greases 4', 5' and 6' were prepared according to the procedure described in Example 1 in conformity with the blending prescriptions shown in Table 1. These greases comprise polyol complex ester as a base oil, but do not comprise inactivating agent for metal and/or antioxidant of secondary aromatic amine antioxidant employed in the present invention.

Properties of these greases are shown in Table 1. These greases were subjected to the property tests for copper contact as described in Example 1. The results obtained are shown in Table 2.

TABLE 1

| Grease | | 1 | 2 | 1' | 2' | 3'(3) | 4' | 5' | 6' |
|---|---|---|---|---|---|---|---|---|---|
| Ingredients(1) | Polyol complex ester(2) | 80.8 | 40.5 | 84.8 | 44.0 | | 80 | 80.8 | 80.8 |
| | Polyol ester Diphenylether(7) | | 40.5 | | 44.0 | | | | |
| | Lithium stearate | | | 14.7 | 11.5 | | | | |
| | Quaternary ammonium salt-containing mineral(5) | 18.7 | 18.5 | | | | 19 | 18.7 | 18.5 |
| | Benzotriazole | 0.3 | 0.3 | 0.3 | 0.3 | | | 0.3 | |
| | Diphenylamine(6) | 0.2 | 0.2 | 0.2 | 0.2 | | | | 0.2 |
| | Phenolic antioxidant | | | | | | 1.0 | | |
| Properties of greases | Consistency (JIS-K-2220) | 338 | 332 | 321 | 320 | 314 | 330 | 338 | 338 |
| | Dropping point (°C.) (JIS-K-2220) | | | 206 | 204 | 240 | | | |
| | Evaporation loss (%) (99%, 22H)(JIS-K-2220) | 0.39 | 0.35 | 0.27 | 0.27 | 1.1(4) | 0.40 | 0.4 | 0.4 |
| | Oil separatrion (%) (100° C., 24H)(JIS-K-2220) | 3.0 | 0.7 | 3.5 | 3.7 | 5.9(4) | 3.5 | 3.0 | 3.0 |

(1)Unit of blending amount of the ingredients is percents by weight.
(2)Nihon Yushi Inc. "Unistar C 33 71A (pour point: −47.5° C.)"
(3)Blending prescription is unknown.
(4)Value at 120° C./24 H.
(5)National Red Corp. "PARAGEL"
(6)Matsumura Oil Research Corp. "MORESCO RP-42S"
(7)Pour Point: −22.0° C.

TABLE 2

| Grease | | | 1 | 2 | 1' | 2' | 3' | 4' | 5' | 6' |
|---|---|---|---|---|---|---|---|---|---|---|
| Anticorrosion and Copper contact resistance | 160° C. 42 hours | Viscosity change of grease | small | no | vernish | dried | small | dried | — | — |
| | | Appearance of copper contact | yellow | | brown-yellow or red | | | | — | — |
| | | Contact(1) resistance (mΩ) | ≦100(2) | | | 200≦(3) | | | — | — |
| | 160° C. 100 hours | Viscosity change of grease | slightly dried | — | — | — | — | dried | | |
| | | Appearance of copper contact | brown | — | — | — | — | yellow | | |
| | | Contact resistance (Ω)(8) | 1.9 | — | — | — | — | 27 | 8.0 | 3.5 |
| | 60° C., 95% RH 120 hours | Contact resistane (mΩ) | | | ≦200 | | | 200≦ | ≦200 | |
| Durability of the sliding | Voltage drop (mV) | | ≦100(4) | | 100≦ | | — | — | — | — |
| | Insulation deterioration (MΩ) | | 20≦(6) | | 20≦(7) | | — | — | — | — |

TABLE 2-continued

| Grease | 1 | 2 | 1' | 2' | 3' | 4' | 5' | 6' |
|---|---|---|---|---|---|---|---|---|
| switch | | | | | | | | |

Figure 5:
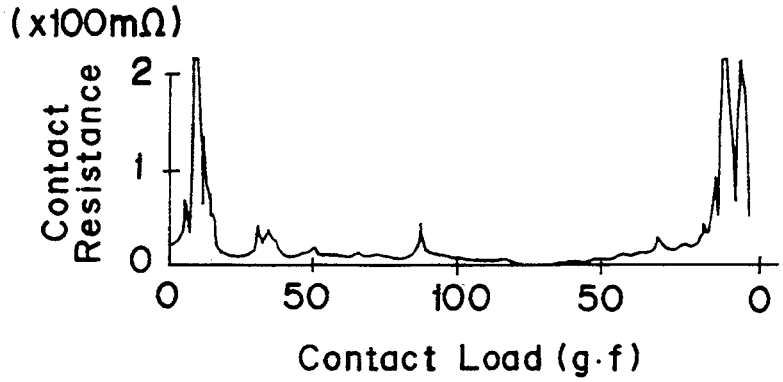
FIG. 5 is the chart of contact resistance of the copper contact on which no grease is applied.
Figure 6:
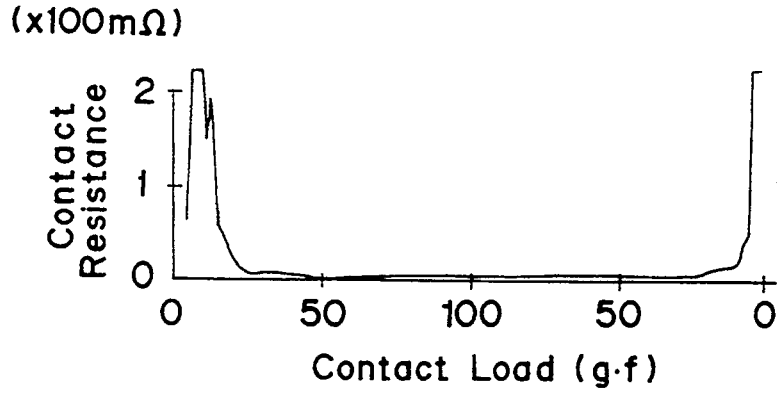
FIGS. 6–11 are the charts of contact resistance of the copper contact on which the grease sample is applied.
Figure 7:
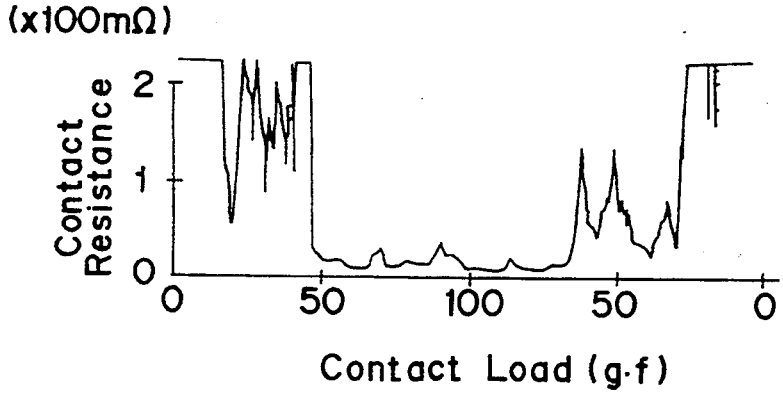
Figure 8:
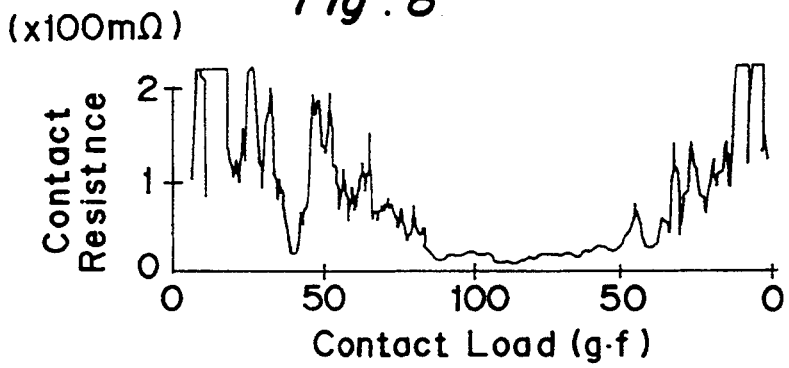
Figure 9:
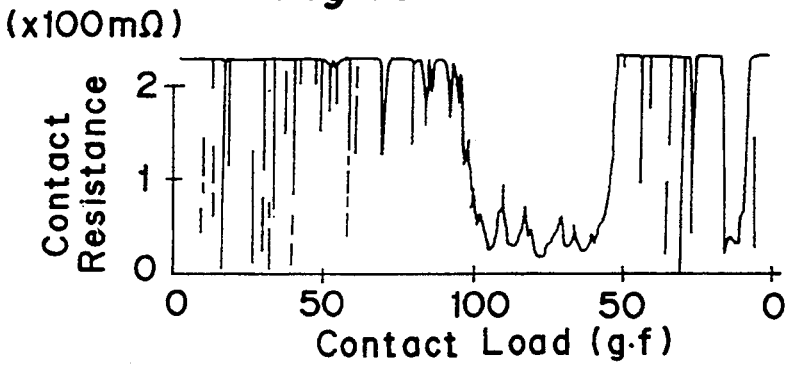
Figure 10:
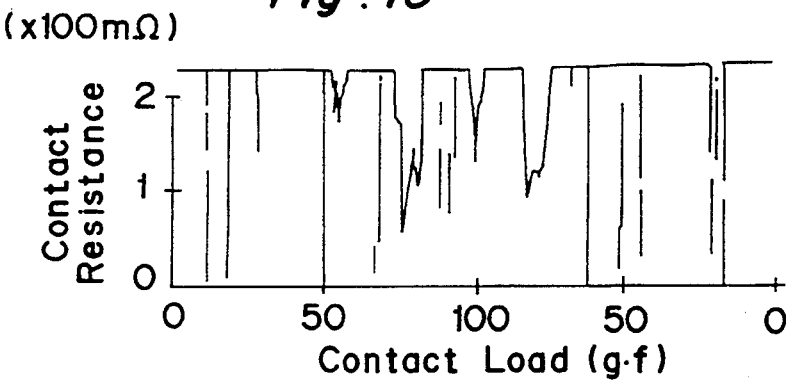
Figure 11:
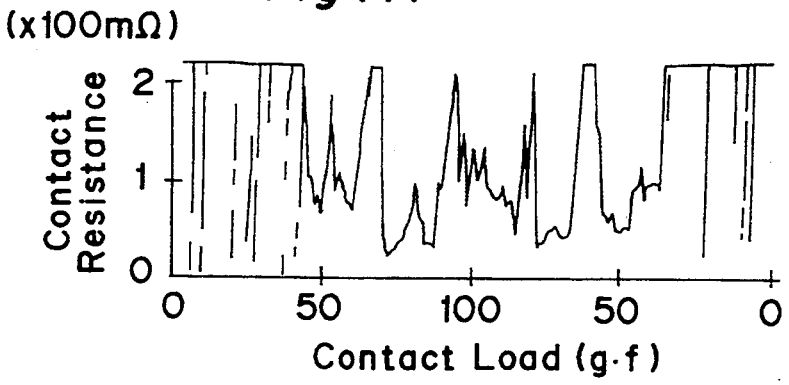
Figure 12:
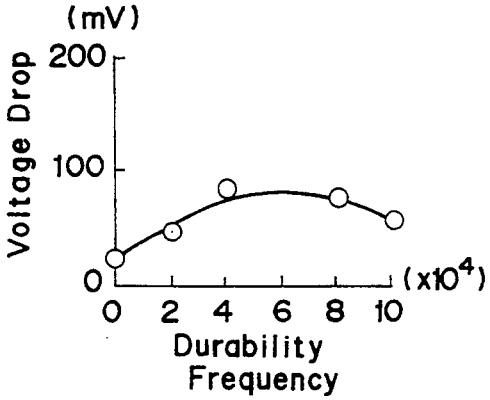
FIGS. 12–14 are the graphs showing relation between voltage drop and durability frequency of the copper contact on which the grease sample is applied.
Figure 13:
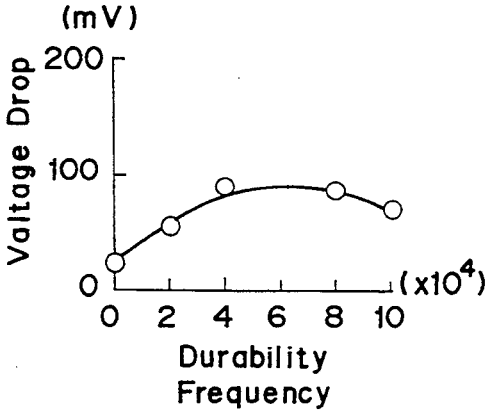
Figure 14:
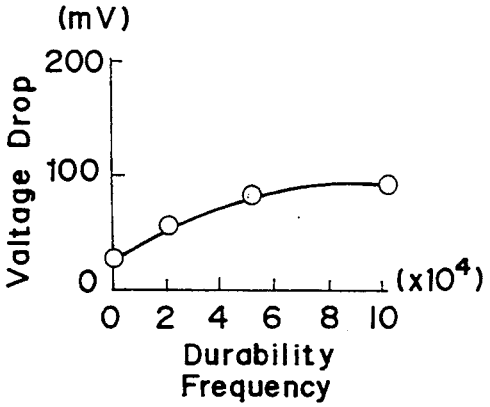
Figure 15:
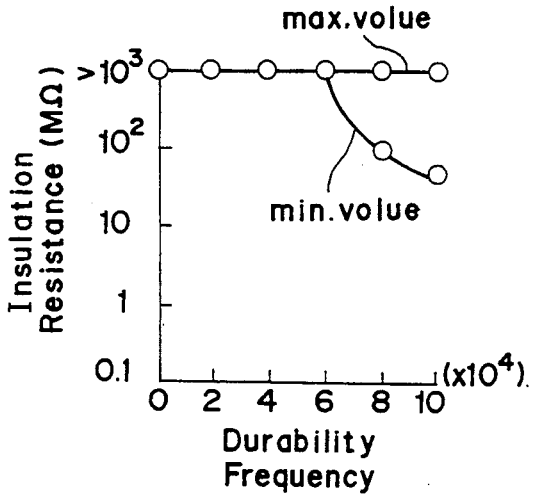
FIGS. 15–17 are the graphs showing relation between insulation resistance and durability frequency of the copper contact on which the grease sample is applied.
Figure 16:
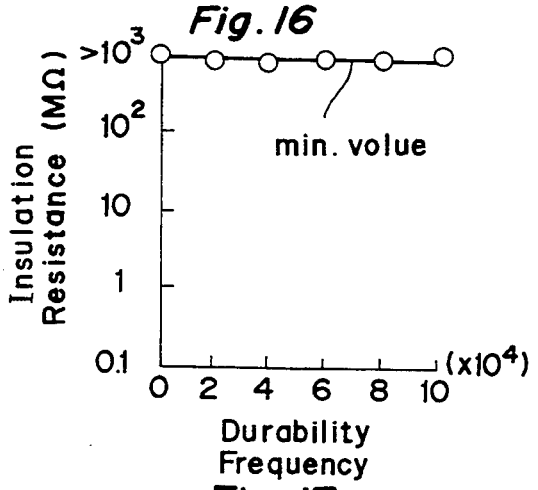
Figure 17:
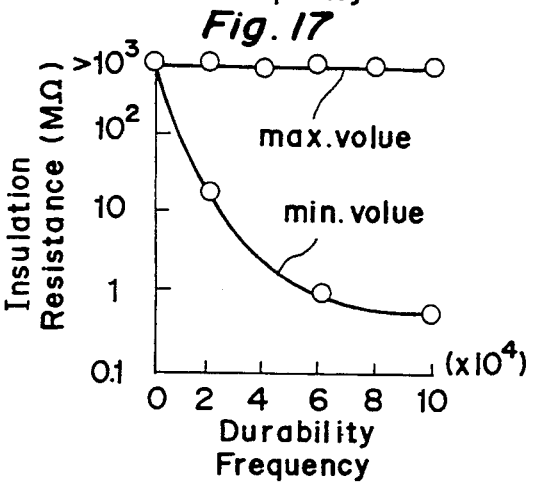
Figure 18:
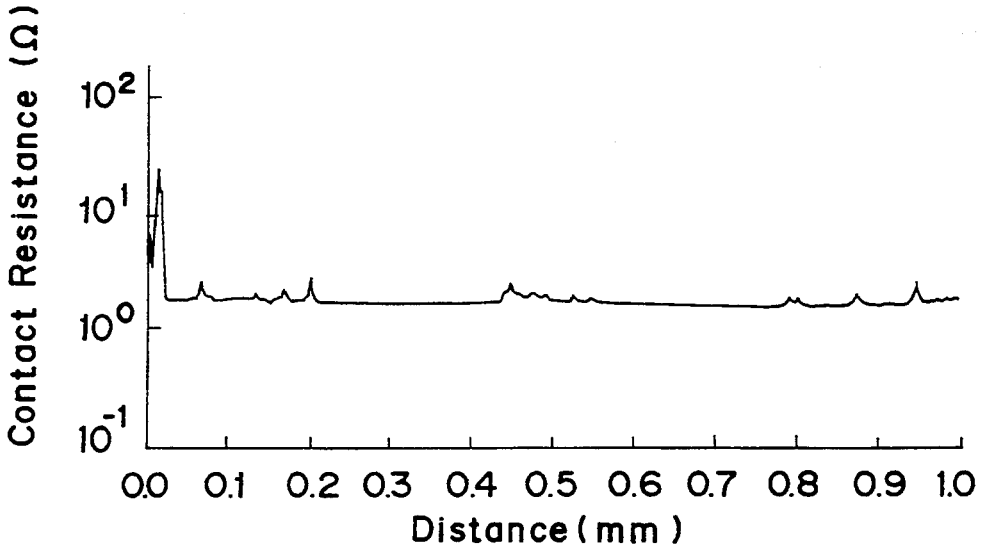
FIGS. 18–21 are the charts of contact resistance of the 160° C. temperature 100 hour retained copper contact on which the grease sample is applied.
Figure 19:
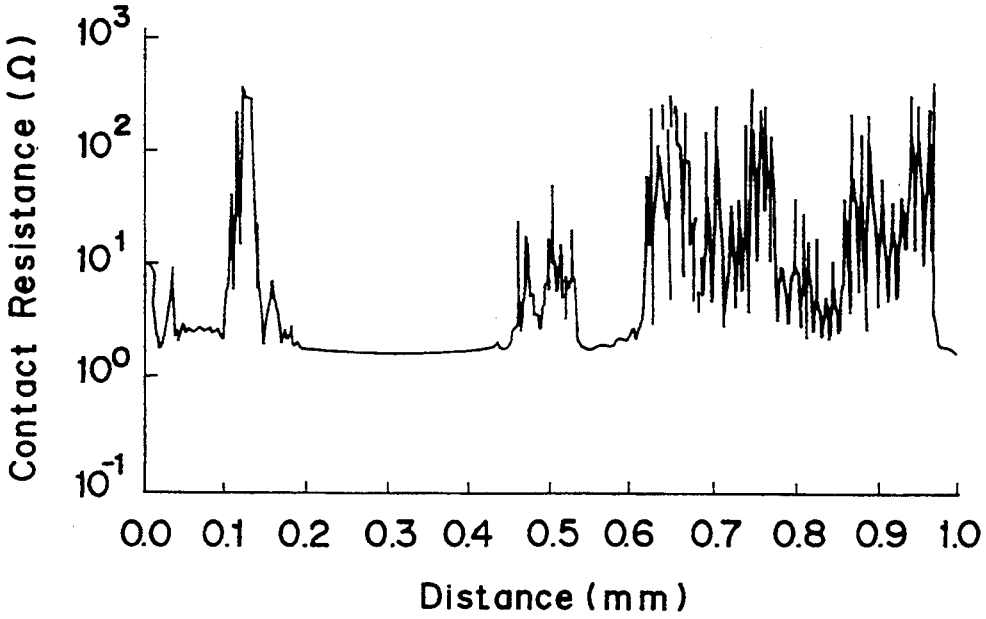
Figure 20:
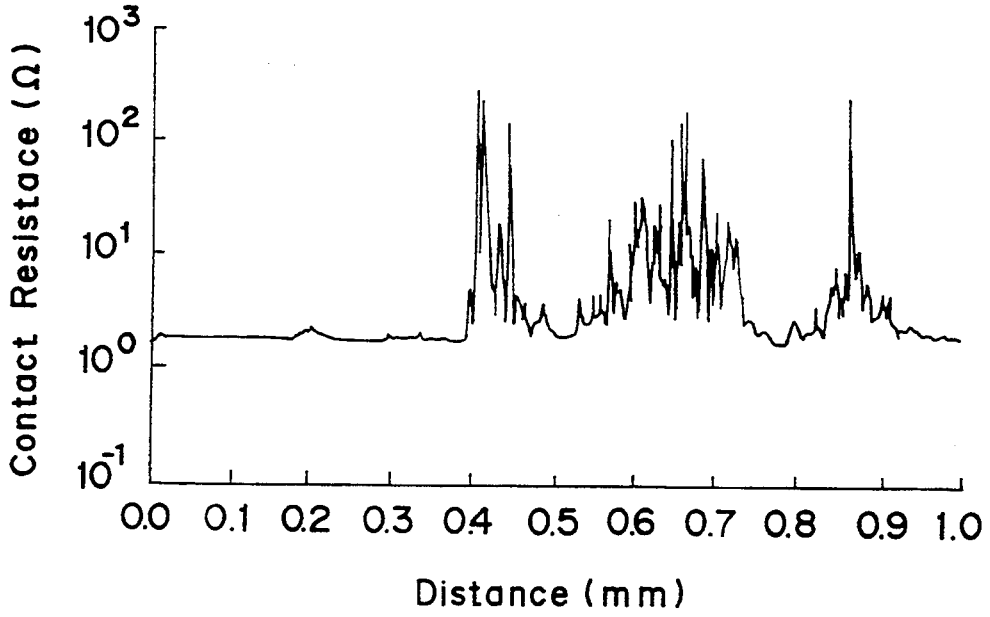
Figure 21:
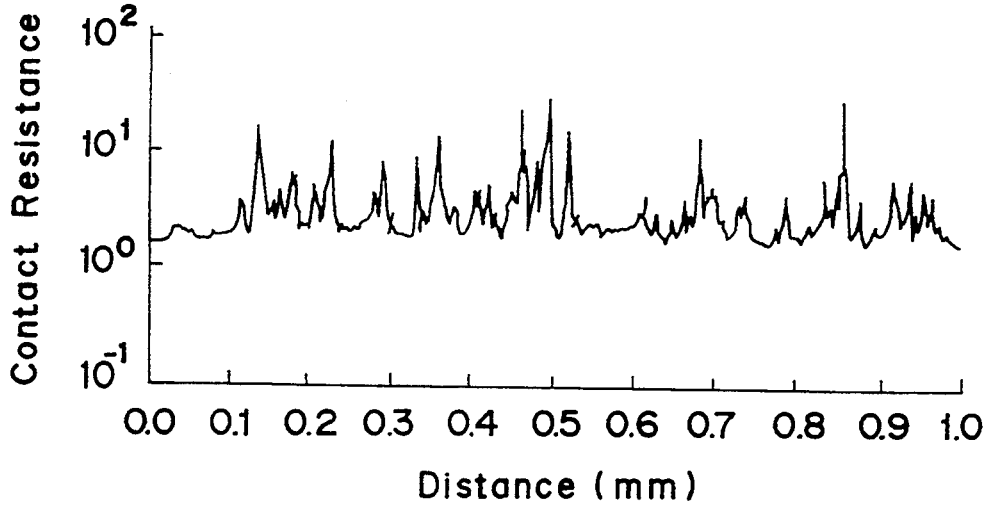

(1)Values measured on a load of from 0 to 100 g; Contact resistances before test are shown in FIG. 5.
(2)See FIG. 6 for grease 1 and FIG. 7 for grease 2.
(3)See FIGS. 8, 9, 10 and 11 for grease 1', 2', 3' and 4' resepctively.
(4)See FIG. 12 for grease 1 (insulator:nylon 66 with which inorganic filler is blended) and FIG. 13 for grease 1 (insulator:unsaturated polyester).
(5)See FIG. 14 for grease 1' (insulator:nylon 66 with which inorganic filler is blended).
(6)See FIG. 15 for grease 1 (insulatyor:nylon 66 with which inorganic filler is blended) and FIG. 16 for grease 1 (insulator: unsaturated polyester).
(7)See FIG. 17 for grease 1' (insulator:nylon 66 with which inorganic filler is blended).
(8)Mean value at contact pressure of 40 g; See FIGS. 18, 19, 20 and 21 for grease 1, 4', 5' and 6' respectively.

As apparent from Table 2 and FIGS. 18–21, the specific additives particularly exert potent influence upon increase of contact resistance of the copper plate at high temperature (160° C.) for many hours (100 hours).

The grease according to the present invention is a durable grease for copper contact which is fit for use under the condition of low and high temperature (ca. −40° C.–ca. 160° C.) and much moisture and which not only does not corrode the copper contact but also does not bring about increased electrical contact resistance caused by its deterioration with the passage of time. The grease according to the present invention gives good durability to the switch having a copper electrical contact under high temperature conditions, such as arc generating conditions. In particular, the grease according to the present invention maintains contact resistance of the copper electrical contact in low values under high temperature condition such as arc generating condition. These preferred properties of the grease are attributable to the following synergetic effects (i) and (ii):

(i) synergetic effect of the polyol complex ester base oil together with quaternary ammonium salt-containing clay mineral thickening agent, (ii) synergetic effect of specific antioxidant additive agent together with specific copper deactivator agent. The synergetic effect (i) is illustrated by "viscosity change of grease", "voltage drop" and "pourpoint" shown in the Table-2 of the present specification. The synergetic effect (ii) is illustrated by the contact resistance shown in the FIG. 18–21, wherein the grease according to the present invention shows the lowest contact resistance.

What is claimed is:

1. A grease for copper electrical contact which comprises 100 parts by weight of polyol complex ester base oil, 10–30 parts by weight of quaternary ammonium salt-containing clay mineral, 0.05–3 parts by weight of secondary aromatic amino antioxidant and 0.05–3 parts by weight of copper deactivator selected from the group consisting of benzotriazoles, thiadiazoles and N,N'-disalicylidene-1,2-diaminopropane.

2. A grease for a copper electrical contact, which comprises 100 parts by weight of base oil which consists of diphenylether having alkyl substituents represented by the formula (I) in an amount up to 50% by weight and the remainder being polyol complex ester, 10–30 parts by weight of quaternary ammonium salt-containing clay mineral, 0.05–3 parts by weight of secondary aromatic amine antioxidant, and 0.05–3 parts by weight of a copper deactivator selected from the group consisting of benzotriazoles, thiadiazoles, and N,N'disalicylidene-1,2-diaminopropane:

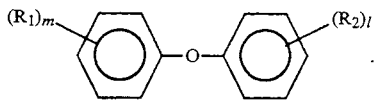

I wherein $R_1$ and $R_2$ are same or different $C_{10}$–$C_{22}$ alkyl groups which may have a branched chain and m and l are integer of from 0 to 5, provided that $6 \geqq m+l \geqq 1$.

* * * * *